United States Patent [19]

Kleven

[11] 4,008,152

[45] Feb. 15, 1977

[54] METAL SEPARATING PROCESS AND APPARATUS

[76] Inventor: Johnny Hilmer Kleven, 1325 N. Fairview, Burbank, Calif. 91505

[22] Filed: Sept. 15, 1975

[21] Appl. No.: 613,366

[52] U.S. Cl. ..... 209/444

[51] Int. Cl.[2] ..... B03B 5/74

[58] Field of Search ..... 209/434–436, 209/451, 452, 444, 479, 481

[56] References Cited

UNITED STATES PATENTS

| | | | |
|---|---|---|---|
| 987,866 | 3/1911 | Earle | 209/452 X |
| 1,081,421 | 12/1913 | Arnold | 209/434 X |
| 1,985,514 | 12/1934 | McCleery | 209/444 X |
| 1,986,778 | 1/1935 | Hinkley | 209/452 |
| 2,064,554 | 12/1936 | Mahoney et al. | 209/452 |
| 2,618,388 | 11/1952 | Rawlings | 209/451 |

*Primary Examiner*—Frank W. Lutter
*Assistant Examiner*—Ralph J. Hill
*Attorney, Agent, or Firm*—Willie Krawitz

[57] ABSTRACT

Heavy metals such as gold, silver platinum, copper, etc., in the free state, are separated from their ore by applying water and the ore in finely divided form to at least three rotating, inclined, spiral grooved discs driven from a common shaft. The grooves are closely spaced and with declining pitch from the periphery to an annulus at the center of the disc. The free metal tends to sink to the bottom of the grooves and the lighter ore is washed away as the metal moves along the spiral grooves to the annulus. The free metal and any remaining ore is fed from the annulus to the succeeding disc and the process is repeated.

9 Claims, 1 Drawing Figure

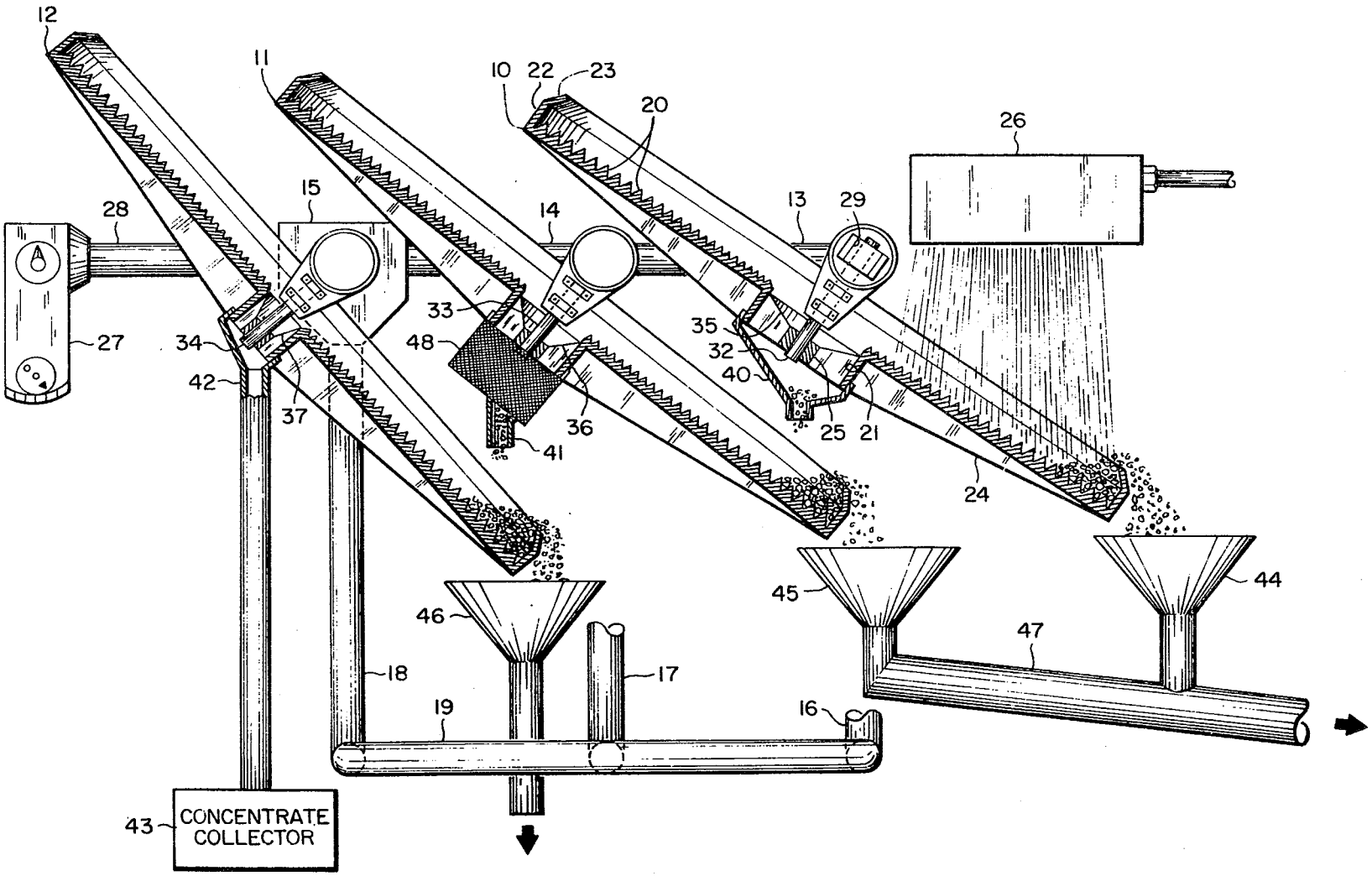
CONCENTRATE COLLECTOR

METAL SEPARATING PROCESS AND APPARATUS

BACKGROUND OF THE INVENTION

This invention relates to a process and apparatus for separating heavy metals such as gold, silver, platinum, copper, lead, etc., in their free state, from their surrounding ore. In some instances, the metal is present in mine tailings which heretofore had little, if any, commercial value because of the large recovery costs, and hence were abandoned.

In other instances, the metal is present in a natural occurring ore body, but not of sufficient size to permit economic recovery by conventional processes.

Various types of apparatus have in the past been employed to recover precious metals such as gold from tailings, raw ore, etc., using water washing techniques. One type of apparatus employed an inclined grooved wheel separator to which was fed a supply of ore which was then water washed. Gold particles sank to the bottom of the grooves and the rotation of the wheel caused the gold to be moved to a central orifice where it was recovered.

The basic problems with employing a single wheel or a plurality of wheels involved the use of feed augers for every wheel and the necessity for maintaining a uniform feed to each wheel. Once the beneficiated ore was removed from a wheel, it tended to dry out in a non-uniform fashion; this made it difficult to feed it uniformly to a succeeding wheel even with a mechanical device such as an auger.

Furthermore, more grooved-wheel separators produced a spectrum of ore grades each of which required separate treatment.

Consequently, many bodies of ore tailings still exist which contain gold but which could not be further economically refined with the available apparatus.

It is, therefore, an object of this invention to provide a process and apparatus therefor which is adapted to separate heavy metals including precious metals from their associated ore such as tailings, raw ore, sluice box cleanings, sand bodies such as found in rivers, in waste from sand plants, etc.

Other objects of this invention will become apparent from the description and single drawing to follow which shows a cross-section view of the apparatus of this invention in side elevation.

SUMMARY OF THE INVENTION

According to the invention, the process and apparatus therefor provides a plurality of inclined grooved wheels, each having an outer rim to retain ore material on the wheel surface. The grooves are tightly packed with a minimum of flat surface between each groove so that the free flow of dressing water is not a significant factor in the process. The grooves are spiralled inwardly with a declining pitch and terminate in a central annulus which leads to a downwardly inclined feed funnel.

A succeeding wheel is fed directly from the funnel, with at least three wheels and as many as six wheels being employed. The number of wheels employed depend on such factors as the concentration of metal in the ore, the mesh size of the ore, wheel speed, wheel size and groove spacing, the amount of water employed, the cohesiveness of the ore itself, etc. A water feed system is provided to produce a slurry by applying water thereto, the heavy gold particles settle to the bottom of the grooves and are rotated toward the center orifice of the wheel along with some ore. The concentrate is then fed as a slurry to the funnel and downwardly by gravity feed along the funnel to the succeeding wheel where the process is repeated. After successive treatments with at least three wheels and as many as six wheels, if necessary, a highly concentrated gold ore is produced.

The process is not only continuous, rather then being a batch operation, but also can be continuously controlled by regulating: a) the weight and volume of initial feed to the first wheel; b) the amount of water applied; c) the inclination, and d) the speed of each succeeding wheel. This permits the production not only of a concentrated ore but also results in a high recovery which in many cases varies from about 95%-99%. Furthermore, the effect of feeding a slurry of beneficiated ore through the centrally located feed funnel totally eliminates the requirements of feed augers while permitting the controlled flow of slurry from wheel to wheel. The single drawing is a side elevation view, partly in cross section, showing the apparatus of this invention.

In the drawing, a plurality of adjustably inclined grooved wheels 10, 11 and 12 are shown mounted by brackets 13, 14 and 15 on vertical support frames 16, 17 and 18 which are secured at their bases by a horizontal support frame 19. The upper surface of each wheel bears a plurality of grooves 20 which spiral from the periphery of the wheel to a central annulus 21. Each wheel has an outer retaining rim 22 and an inwardly inclined lip 23. This arrangement of rim and lip permits the optimum retention of ore on each wheel. The underside of each wheel provides a plurality of spoked supports 24. A plurality of hubs 25 is provided to permit mounting on a drive shaft. Adjustable water spray bars, only one bar 26 being shown is provided for applying water to slurry the ore after it contacts each wheel. An adjustable speed motor 27 drives a horizontal rotating shaft 28 connecting to belt drives 29 (only one being shown) in each of the brackets 13, 14 and 15. Connecting shafts 32, 33 and 34 connect belt drives 29 to drive gears 35, 36 and 37 mounted in the hubs 25. When the adjustable motor 27 is actuated, the grooved wheels 10, 11 and 12 will be rotated. Collector funnels 40 and 41 are provided on the wheels 10 and 11 to transfer the gold and some of the ore as a slurry to succeeding wheels 11 and 12. A collector funnel 42 transfers the final concentrate to a concentrate collector 43. Funnels 44, 45 and 46 collect the separated ore, tailings, etc., following treatment on each wheel where they may be treated further if necessary or discharged through a connecting pipe 47 to a tail pile. A nugget screen 48 may be employed, if desired, to collect large size gold particles.

The collector wheels 10, 11 and 12 may be constructed of an injection-molded plastic such as a filled nylon, polyester, polyurethane, polypropylene, etc. The grooves 20 in each wheel are preferably V-shaped, and have a declining pitch from the periphery to the central annulus 21. The upper edge of each ridge is sharply angled to maintain the dressing water in the grooves and minimize water overflow. For a 43 inch diameter wheel, a preferred length of spiral would be about 88 inches with a spiral wind of about 1½ turns. A total number of about 30 grooves are suitable for the first two wheels 10 and 11, while the wheel 12 employs 34 grooves per wheel. The groove depth in the first two separator wheels 10, 11 decreases from about 350 mils at the rim to about 280 mils at the annulus. For the third separator wheel 12 and succeeding wheels, the groove depth decreases from about 300 mils at the periphery to about 240 mils at the annulus. Typical annulus diameters for the three wheels are 7 inches, 5 inches and 1.5 inches for the wheels 10, 11 and 12 respectively. The wheels 10, 11 and 12 are adjustably inclined to the horizontal with a decreasing angle; typical inclination angles for a 43 inch wheel are about 120°–150°, 120°–140°, and 100°–125° for wheels 10, 11 and 12 respectively. If additional wheels are employed, typical inclinations are 100°–125°.

When employing a 24 inch diameter wheel, a preferred spiral wind is about two revolutions from periphery to center; a total number of about 15 grooves are suitable.

The 24 inch diameter wheels employ the same groove depth as the corresponding 43 inch wheels.

In operation, heavy metal tailings or ore are applied to the rotating (10–30 RPM) wheel 10 at the downwardly moving side, and below the center annulus 21. The ore may be applied manually, but it is preferable to employ an auger, belt or bucket feed (not shown) to maintain a uniform supply to the first separator wheel 10. Simultaneously, water from spray bar 26 is applied to the ore to form a slurry. Heavy metal is washed to the bottom of the grooves 20 and is rotated along the grooves to the annulus 21. Lighter coarse ore is washed to the periphery of the wheel and over the lip 22 where it is collected and discharged by troughs 44, 45. A slurry of fine ore and heavy metal is passed through the first funnel 40 and then passes downwardly to the separator wheel 11 for further separation. Additional spray bars are employed for the wheels 11 and 12. Further treatment of the ore on the wheels 11 and 12 effects a metal recovery of about 95%–99% efficiency.

In another embodiment of this invention, raw ores, tailings, etc., are fed to a first separator wheel and a second separator wheel on a common mount, and having the same inclination as the first wheel, is fed the overflow from the first wheel. The beneficiated ore from the first separator wheel bypasses the second wheel and is fed through the funnels at the annulus directly to the third wheel. Consequently, the second wheel functions solely to recover any gold lost in the overflow at the first wheel separation stage.

Employing a ½ H.P. adjustable drive, the apparatus of this invention can process 1.5–2 tons of ore per hour and this permits the working of tailings which previously had been considered impossible.

I claim:

1. A process of separating metals in the free state from ore which comprises the steps of:

a. applying the ore containing the metal successively to a plurality of downwardly inclined, rotatable, flat pan-shaped separating wheels, said wheels being driven by a common shaft and providing (i) a peripheral retaining lip, (ii) a central annulus, and (iii) a plurality of spiral grooves disposed on the upper surface of each wheel and directed from the wheel periphery to the annulus, each of said wheels being concentrically rotatable about its central annulus;

b. forming a water slurry with the ore on each wheel;

c. washing lighter waste ore out of the grooves and downwardly over the outer retaining lip;

d. forwarding the slurry of beneficiated ore inwardly and upwardly along the spiral grooves to the central annulus and downwardly through a funnel positioned around the annulus;

e. applying the slurry to the next succeeding wheel; and f. repeating the process until at least three wheel separations have been effected.

2. The process of claim 1 in which the separating wheels are adjustably inclined.

3. The process of claim 1 in which each wheel in succession bears an angle of inclination to the horizontal of about 120°–150°, 120°–140° and 100°–125°.

4. The process of claim 1 in which the first two separating wheels are commonly mounted, overflow from the first separator wheel is fed directly to the second wheel and beneficiated ore is fed directly through the funnels to the third wheel.

5. The process of claim 1 in which the metal is selected from the class consisting of: gold, silver, platinum, copper and lead.

6. An apparatus for separating metals in the free state from ore which comprises:

a. a plurality of at least three downwardly inclined, serially mounted, rotatable, flat pan-shaped separating wheels including a common shaft means for driving said wheels, each wheel providing (i) a peripheral retaining lip, (ii) a central annulus, and (iii) a plurality of spiral grooves disposed on the upper surface of each wheel and directed from the wheel periphery upwardly and inwardly to annulus, each of said wheels being concentrically rotatable about its central annulus;

b. means to form a water slurry with the ore on each wheel; and c. a funnel positioned around the annulus of each wheel for forwarding beneficiated ore along the spiral grooves from the central annulus downwardly to the succeeding wheel.

7. The apparatus of claim 6 in which the separating wheels are adjustably inclined.

8. The apparatus of claim 6 in which each wheel in succession bears an angle of inclination to the horizontal of about 120°–150°, 120°–140° and 100°–125° thereafter.

9. The apparatus of claim 6 in which the said wheels are constructed of an injection molded plastic material.

* * * * *